US005886478A

United States Patent [19]

Smith et al.

[11] Patent Number: 5,886,478

[45] Date of Patent: Mar. 23, 1999

[54] INTEGRAL IGNITER FOR ELECTRODELESS LAMPS

[75] Inventors: Raymond A. Smith, Severna Park; Roy G. Anderson, Baltimore; Edward H. Hooper, Catonsville, all of Md.

[73] Assignee: Northrop Grumman Corporation, Los Angeles, Calif.

[21] Appl. No.: 969,248

[22] Filed: Nov. 13, 1997

[51] Int. Cl.[6] ..... H05B 41/16

[52] U.S. Cl. ..... 315/248; 315/344; 315/276; 313/594

[58] Field of Search ..... 315/248, 344, 315/39, 267, 276; 313/234, 638, 594

[56] References Cited

U.S. PATENT DOCUMENTS

| | | | |
|---|---|---|---|
| 4,894,590 | 1/1990 | Witting | 315/248 |
| 4,902,937 | 2/1990 | Witting | 315/248 |
| 4,982,140 | 1/1991 | Witting | 315/248 |
| 5,047,693 | 9/1991 | Roberts et al. | 315/248 |
| 5,519,285 | 5/1996 | Ukegawa et al. | 313/594 |
| 5,747,945 | 5/1998 | Ukegawa et al. | 315/248 |

*Primary Examiner*—Don Wong
*Assistant Examiner*—Haissa Philogene
*Attorney, Agent, or Firm*—Walter G. Sutcliff

[57] ABSTRACT

A coil extension of the RF coupling coil, surrounding an electrodeless light bulb containing an inert gas and selected chemical elements, generates a voltage at the distal end thereof which is higher than that which appears across the RF coupling coil proper, and wherein the high voltage from the distal end of the coil extension is returned to the light bulb through a point contact electrode located in relatively close proximity to the low voltage end of the RF coupling coil.

7 Claims, 2 Drawing Sheets

FIG. 1
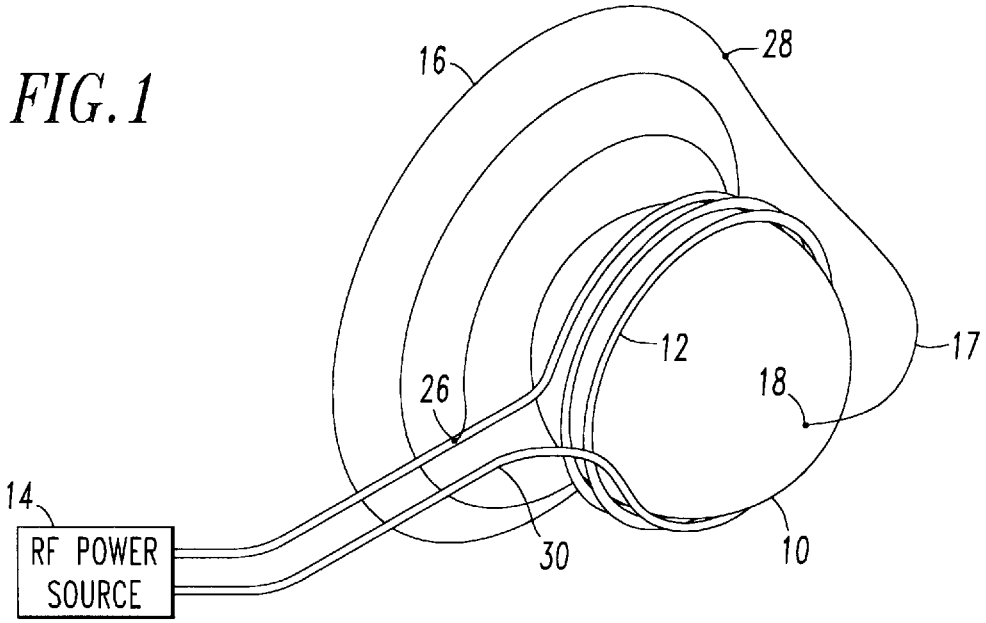
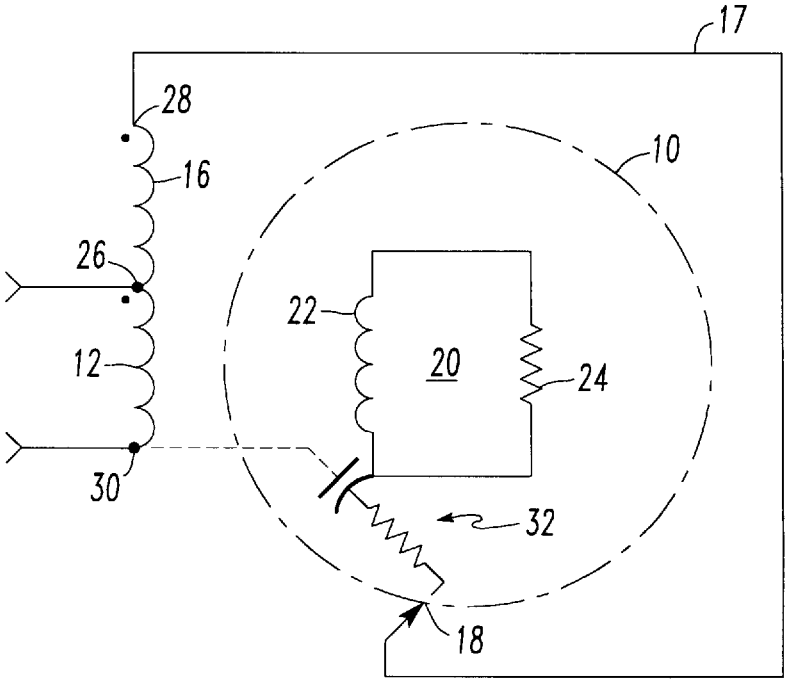
FIG. 2

INTEGRAL IGNITER FOR ELECTRODELESS LAMPS

BACKGROUND OF THE INVENTION

1. Field of the Invention

This invention relates generally to high intensity discharge electrodeless lamps and more particularly to an improved apparatus for starting an electrodeless lamp without the need for an external starting aid.

2. Description of Related Art

Electrodeless lamps comprise light sources which are based on generating light directly by a plasma generated and sustained by RF excitation. This is opposed to fluorescent lamps where electrical excitation of a plasma, which may include mercury, produces ultraviolet photons which in turn impact on phosphors located on an inside surface of a tubular body which produces light as a secondary product.

As is generally well known, an electrodeless lamp is typically comprised of a closed, transparent quartz container having a low pressure fill consisting of an inert gas and selected chemical elements. Typically, the gas is comprised of argon and element(s) selected from Group VI-A of the periodic table of elements, e.g. sulfur. The material in the bulb is heated by the concentration of RF energy applied to the bulb, whereupon the inert gas is ionized and the supplementing elements are vaporized to form a high temperature plasma which emits highly concentrated light. Where sulfur is used as the element being vaporized, the light which is generated is similar to bright sun light.

RF coupling to the bulb can be either inductive, capacitive or by way of a microwave cavity. Where, for example, coupling to the bulb is inductive through an excitation coil wound about the bulb, and RF power is applied to the bulb in the order of 100–200 watts at a frequency of 10 MHz–100 MHz, typically 27.12 MHz, which is in the industrial, scientific, medical (ISM) band, difficulty is often encountered in starting the plasma generation process. The use of a Tesla coil, an external high voltage field producing device, or other forms of starting aids are required to induce ignition.

SUMMARY

Accordingly, it is the primary object of the subject invention to provide an improvement in apparatus for starting electrodeless lamps.

It is a further object of the invention to provide apparatus for starting an electrodeless lamp without the help of an external starting aid.

It is another object of the invention to provide apparatus for starting an electrodeless lamp which is incorporated within the lamp coupling assembly.

The foregoing and other objects are achieved by apparatus for starting an electrodeless lamp including a light bulb containing a low pressure fill consisting of an inert gas and one or more selected chemical elements, comprising: an RF power source; a primary RF power coupling coil coupled to the RF power source and wound around the bulb in a predetermined rotational sense for coupling RF power from the source to bulb; and an inductively coupled coil extension of the primary RF power coupling coil wound around the bulb in the same predetermined rotational sense as the primary RF power coupling coil and having a low voltage end connected to the high voltage end of the primary power coupling coil and wherein the high voltage end thereof is connected to a starting electrode on the bulb which is located in relatively close proximity to the low voltage end of the primary power coupling coil. The two coils can be mutually adjacent or integral with one another depending on the specific application.

Further scope of applicability of the present invention will become apparent from the description provided hereinafter. It should be understood, however, that the detailed description and specific examples set forth therein, while disclosing a preferred embodiment of the invention, is provided by way of illustration only, since various changes and modifications coming within the spirit and scope of the invention will become apparent to those skilled in the art from this detailed description.

BRIEF DESCRIPTION OF THE DRAWINGS

The present invention will become more fully understood from the detailed description provided hereinafter and the accompanying drawings which are provided by way of illustration only, and thus are not meant to be limitative of the invention, and wherein:

FIG. 1 is an electrical diagram which is illustrative of a first embodiment of the invention;

FIG. 2 is an electrical schematic diagram further illustrative of the embodiment of the invention shown in FIG. 1.

DETAILED DESCRIPTION OF THE INVENTION

Figure 3:
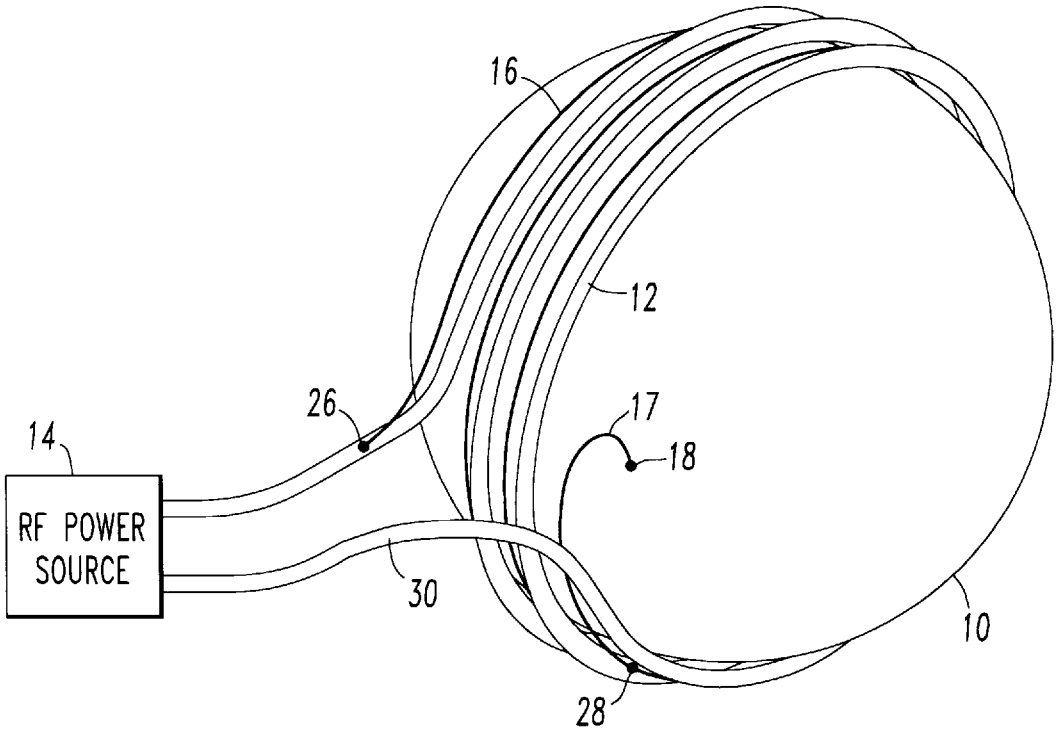
FIG. 3 is an electrical diagram illustrative of a second embodiment of the invention.

Referring now to the drawing figures and more particularly to FIG. 1, shown thereat is a first preferred embodiment for igniting an electrodeless light bulb 10 which comprises a transparent container, typically spherical in shape and comprised of, for example, quartz. Such a shape and construction is not necessarily that as shown, and may be comprised of any convenient construction capable of containing a low pressure fill, not shown, comprised of an inert gas and selected chemical element(s), for example, sulfur. Surrounding the light bulb 10 as shown in FIG. 1 is a primary RF power coil 12 for exciting the contents of the light bulb 10 when driven by an RF voltage from an RF power source 14 and is typical of most inductive type coupling implementations.

The present invention is directed to the inclusion of a voltage boost coil extension 16 in the lamp RF coupling assembly wound in the same rotational and voltage polarity sense as the primary RF power coil 12 and being inductively coupled thereto in an autotransformer relationship for generating a voltage at the outer or distal end which is higher than that which appears across the primary RF power coil 12. The high voltage from the distal end of the coil extension 16 is returned and applied to the low pressure fill in the bulb 10 through a point contact electrode 18 placed near the low voltage end of the power coil 12.

This is further shown in FIG. 2 where the equivalent circuit of a normally lighted electrodeless lamp is schematically depicted as a simple plasma loop 20 within the boundary of the bulb 10 and which consists of an inductance 22 and a resistance 24. The inductance portion 22 of the loop 20 in effect acts as a secondary winding of an air core transformer which is also inductively coupled to the RF power coil 12 which forms the primary winding of the transformer.

The voltage boost coil 16 is shown connected to the primary power coil 12 so that the windings 12 and 16 form an autotransformer. The two windings 12 and 16 have a common connection point 26, which is the high voltage end of the coil 12 and the low voltage end of the coil 16. As such, the RF voltage induced in coil 16 by the coupling coil 12 adds to the voltage across coupling 12 to produce a relatively high RF voltage at the outer or high voltage end 28 and which is coupled to the start electrode 18 by a connecting lead 17. Lead 17 may also simply be a portion of the conductor making up the coil extension 16.

By locating the start electrode 18 relatively close to the low voltage end 30 of the primary power coil 12, a relatively high RF electric field is produced with the bulb 10 which upon the application of RF power voltage from the RF power source 14, provides the initial ionizing potential across an equivalent resistive-capacitive path shown by reference numeral 32 within the bulb 10. During normal operation of the electrodeless bulb 10 when it is lighted, the excitation coil 12 is loaded by the lighted bulb 10 and the voltage across the coil 12 is lowered. Negligible current flows in the starting extension coil 16 under this condition. It is only prior to lamp starting that the voltage across the coupling coil 12 is high, and the voltage at the end point 28 of the coil extension 16 is significantly higher than it is during normal lighted bulb operation. During this time, current flows in the extension coil 16 only to supply energizing energy to the lamp 10. The conductor size of the extension coil 16 can be made relatively smaller than that of the power coil 12 because negligible current is carried during normal lamp operation.

When power is applied to the coupling coil 12, the higher voltage coupled back to the bulb at the end point 28 of the coil extension 16 provides a very high stress within the confines of the bulb 10 (on the order of 10,000 V/cm) which readily ionizes the inert gas in a small portion of the bulb. This produces sufficient ions within the bulb 10 to initiate coupled conduction within the bulb. As the bulb heats up, this leads to vaporization of the element(s) within the bulb leading to a production of plasma 20, which is accompanied by emission of high intensity light.

While the starting extension coil 16 is shown located adjacent the primary RF power core 12 in FIG. 1, other extension coil configurations are possible. For example, as shown in FIG. 3, the coil extension 16 can be made integral with and/or extended back over the primary power coil 12. This would be just as effective and likely to block less light from the lighted bulb 10. What is important is that the extension coil 16 and starting electrode 18 are incorporated within the lamp coupling assembly so as to eliminate the need for external lamp starting aids.

Having thus shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

We claim:

1. Apparatus for starting an electrodeless lamp including a light bulb containing a low pressure fill consisting of an inert gas and one or more selected chemical elements, comprising:

a source of RF power;

a primary RF power coupling coil having a high voltage end and a low voltage end connected to said source of RF power for coupling RF power from said source to said fill; and a starting coil extension of said primary coil inductively coupled to said primary RF power coupling coil and having a low voltage end connected to the high voltage end of said primary RF power coupling coil and a high voltage end connected to a starting electrode for said bulb located in relatively close proximity to the low voltage end of said primary RF power coupling coil.

2. Apparatus according to claim 1 wherein said starting electrode comprises a point contact electrode on the bulb whereby an initial ionization path is formed between said point contact electrode and the low voltage end of said primary power coupling coil when the primary power coupling coil is energized from said source of RF power.

3. Apparatus according to claim 2 wherein said starting coil extension has a conductor size which is relatively smaller than the conductor size of said primary RF power coupling coil.

4. Apparatus according to claim 2 wherein said starting coil extension is located adjacent said primary power coupling coil.

5. Apparatus according to claim 2 wherein said starting coil extension is integral with said primary power coupling coil.

6. Apparatus according to claim 2 wherein said starting coil extension is wound back over said primary power coupling coil.

7. Apparatus according to claim 1 wherein said primary RF power coupling coil and said starting coil extension are wound in the same rotational sense.

* * * * *